US005664768A

United States Patent [19]

Scabar

[11] Patent Number: 5,664,768

[45] Date of Patent: Sep. 9, 1997

[54] FENCING WIRE RETAINER AND A METHOD OF CONSTRUCTING WIRE FENCES

[76] Inventor: Arnold Lloyd Scabar, General Delivery, Round Hill, Alberta, Canada, T0B 3Z0

[21] Appl. No.: 622,419

[22] Filed: Mar. 27, 1996

[30] Foreign Application Priority Data

Aug. 1, 1995 [CA] Canada ..... 2155150

[51] Int. Cl.[6] ..... E04H 17/24

[52] U.S. Cl. ..... 256/54; 256/48; 256/47; 256/57

[58] Field of Search ..... 256/47, 48, 50, 256/52, 57, 32, 10, 54, 33

[56] References Cited

U.S. PATENT DOCUMENTS

| | | | |
|---|---|---|---|
| 735,121 | 8/1903 | Lombard | 256/57 |
| 747,435 | 12/1903 | Jenkins | 256/57 |
| 1,293,106 | 2/1919 | Jernegan | 256/48 |
| 1,537,129 | 5/1925 | Meaker | 256/57 |
| 1,861,450 | 6/1932 | Ochiltree | 256/57 |
| 2,355,767 | 8/1944 | White | 256/48 |
| 2,631,804 | 3/1953 | Uhlhorn | 256/47 X |
| 2,662,740 | 12/1953 | White | 256/48 |
| 3,161,263 | 12/1964 | Stokes | 256/47 X |
| 3,671,017 | 6/1972 | Sachs | 256/47 |
| 3,972,511 | 8/1976 | Balestrini | 256/47 |
| 4,893,788 | 1/1990 | Chave | 256/47 |
| 6,660,595 | 10/1900 | Sheets | 256/47 |

FOREIGN PATENT DOCUMENTS

| | | | |
|---|---|---|---|
| 7900587 | 3/1988 | Australia | 256/47 |

*Primary Examiner*—Harry C. Kim
*Attorney, Agent, or Firm*—Anthony R. Lambert

[57] ABSTRACT

A fencing wire retainer includes an elongate body having a first end and a second end. A hook is provided at the first end of the body for removably securing the body to a fence post. A radial finger is provided at the second end of the body for removably securing the body to a fence post. The first end and the second end of the body are secured to a fence post with a transversely extending fencing wire retained between the body and the fence post. The fencing wire is preferably positioned in a transverse wire receiving groove.

3 Claims, 6 Drawing Sheets

28
26
26
18
14
16
12
42
36
40
12
38
28
18
16
26
30
10
12
24
18
26

FENCING WIRE RETAINER AND A METHOD OF CONSTRUCTING WIRE FENCES

FIELD OF THE INVENTION

The present invention relates to a fencing wire retainer and a method of constructing wire fences using the fencing wire retainer.

BACKGROUND OF THE INVENTION

Currently wire fences are constructed by using staples as fencing wire retainers to secure fencing wire to fence posts. Fences constructed in this manner are not easily disassembled to get equipment through, nor easily reconfigured.

SUMMARY OF THE INVENTION

What is required is an alternative form of fencing wire retainer and method of constructing wire fences utilizing such fencing wire retainer that will enable wire fences to be easily disassembled and reconfigured, as required.

According to one aspect of the present invention there is provided a fencing wire retainer which includes an elongate body having a first end and a second end. Means is provided at the first end of the body for removably securing the body to a fence post. Means is provided at the second end of the body for removably securing the body to a fence post. The first end and the second end of the body are secured to a fence post with a transversely extending fencing wire retained between the body and the fence post.

With the fencing wire retainer, as described, wire fences can be disassembled and reassembled at will. The preferred means at the first end of the body for removably securing the body to a fence post is in the form of a hook. The hook has an inner arcuate dimension that is greater than the outer arcuate dimension of the fence post. The hook is preferred as it can be rapidly positioned or repositioned on a fence post.

Although beneficial results may be obtained through the use of the fencing wire retainer, as described above, this configuration potentially permits the fencing wire to move within a range limited by the first end and the second end of the body. Even more beneficial results may, therefore, be obtained when the first end of the elongate body has a transverse wire receiving groove. A fencing wire is confined within the transverse wire receiving groove when the first end and the second end of the body are secured to the fence post.

According to another aspect of the present invention there is provided a method of constructing wire fences. Firstly, drive into a ground surface a plurality of fence posts in spaced apart relation. Secondly, extend at least one wire transversely across the plurality of fence posts. Thirdly, provide a fencing wire retainer in accordance with the teachings of the present invention. For best results the fencing wire retainer preferably includes an elongate body having a first end and a second end. A hook at the first end of the body having an inner arcuate dimension that is greater than the outer arcuate dimension of the plurality of fence posts. A wire receiving groove extending transversely across the hook. Means at the second end of the body for removably securing the body to a fence post. Fourthly, secure the at least one transversely extending fencing wire to each of the plurality of fence posts in turn. Hook the first end of the body of the fencing wire retainer around one of the plurality of fence posts. Position the fencing wire within the transverse wire receiving groove and pivot the body to a position substantially parallel to the fence post. Securing the second end of the body to the fence post, thereby maintaining the body substantially parallel to the fence post such that the fencing wire remains confined within the transverse wire receiving groove.

Although beneficial results may be obtained through the use of the method, as describe above, a further addition to the method helps improve the quality of the wire fence when a plurality of strands of fencing wire are to be used. Even more beneficial results may be obtained when the first end of the body of a second fencing wire retainer retaining a second fencing wire overlaps the second end of a first fencing wire retainer retaining a first fencing wire. This locks the first fencing wire retainer in position until the second fencing wire retainer is removed.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
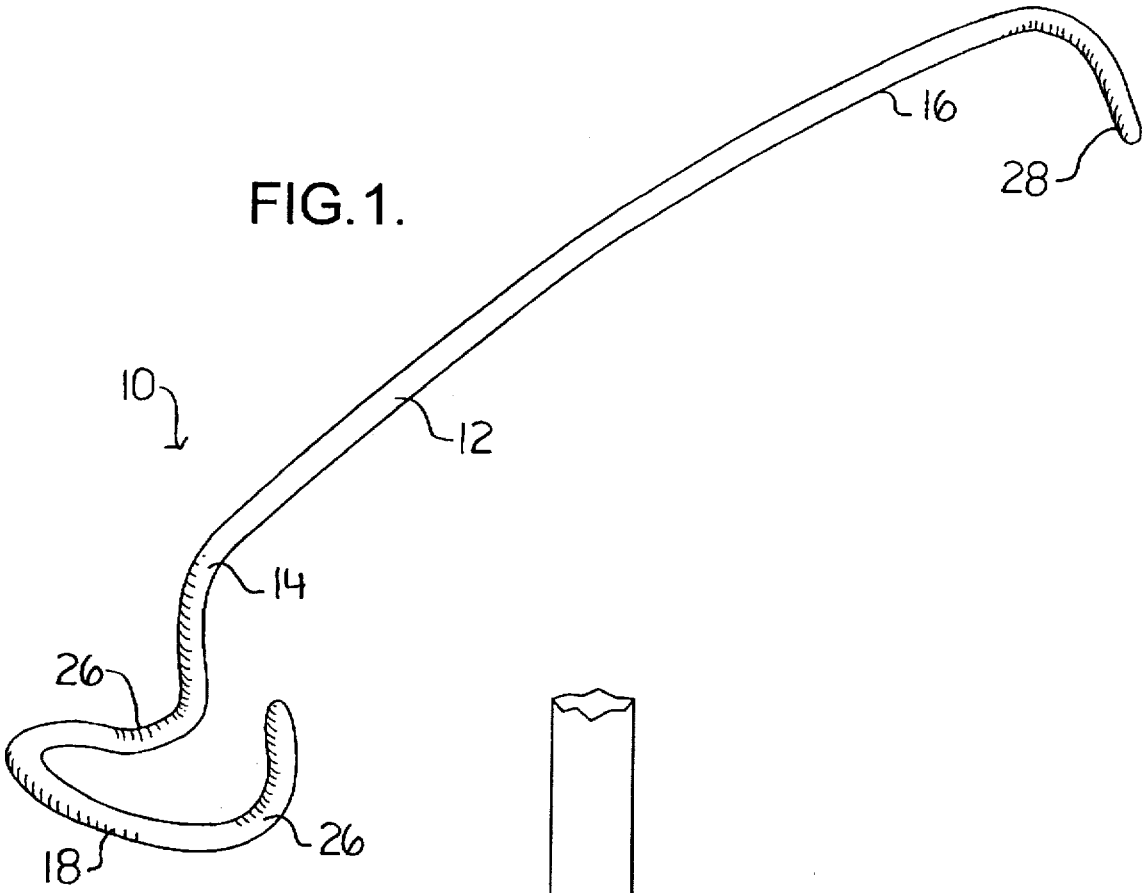
FIG. 1 is a perspective view of a fencing wire retainer constructed in accordance with the teachings of the present invention.

The preferred embodiment, a fencing wire retainer generally identified by reference numeral 10, will now be described with reference to FIGS. 1 through 7.

Figure 2:
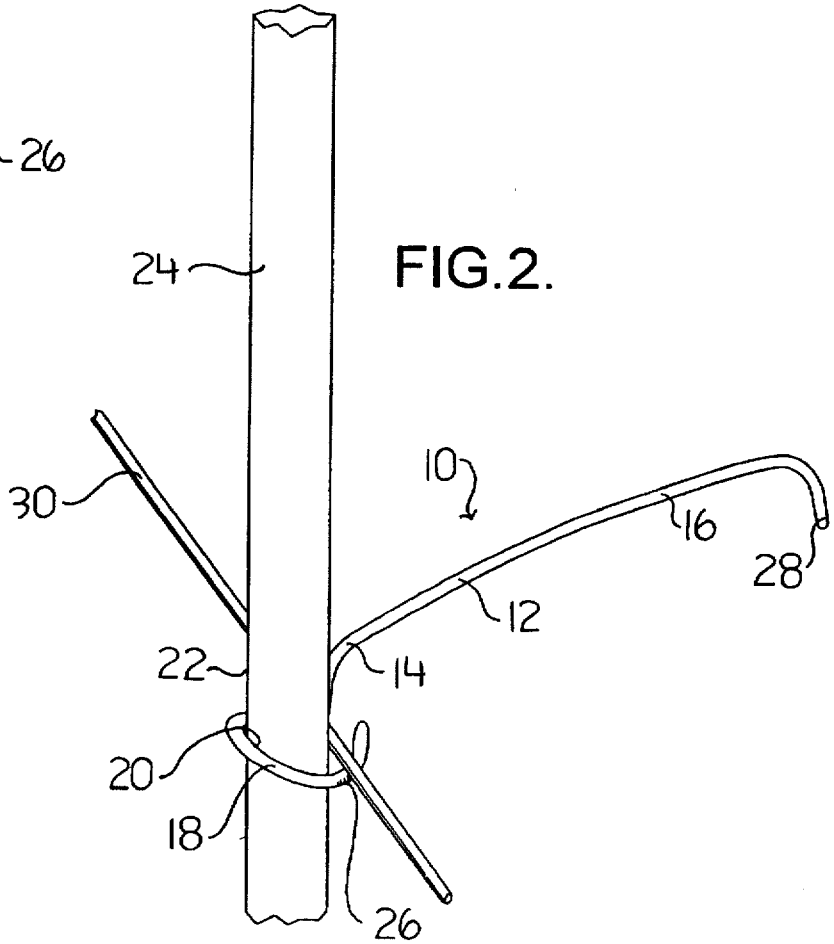
FIG. 2 is a perspective view of the fencing wire retainer illustrated in FIG. 1, illustrating a first step in constructing a three fencing wire fence.

Referring to FIG. 1, fencing wire retainer 10 includes an elongate body 12 having a first end 14 and a second end 16. A hook 18 is positioned at first end 14 of body 12. Referring to FIG. 2, hook 18 has an inner arcuate dimension 20 that is greater than the outer arcuate dimension 22 of a fence post 24. Referring to FIG. 1, a wire receiving groove 26 extends transversely across hook 18. An arcuate radial finger 28 is positioned at second end 16 of body 12.

Figure 3:
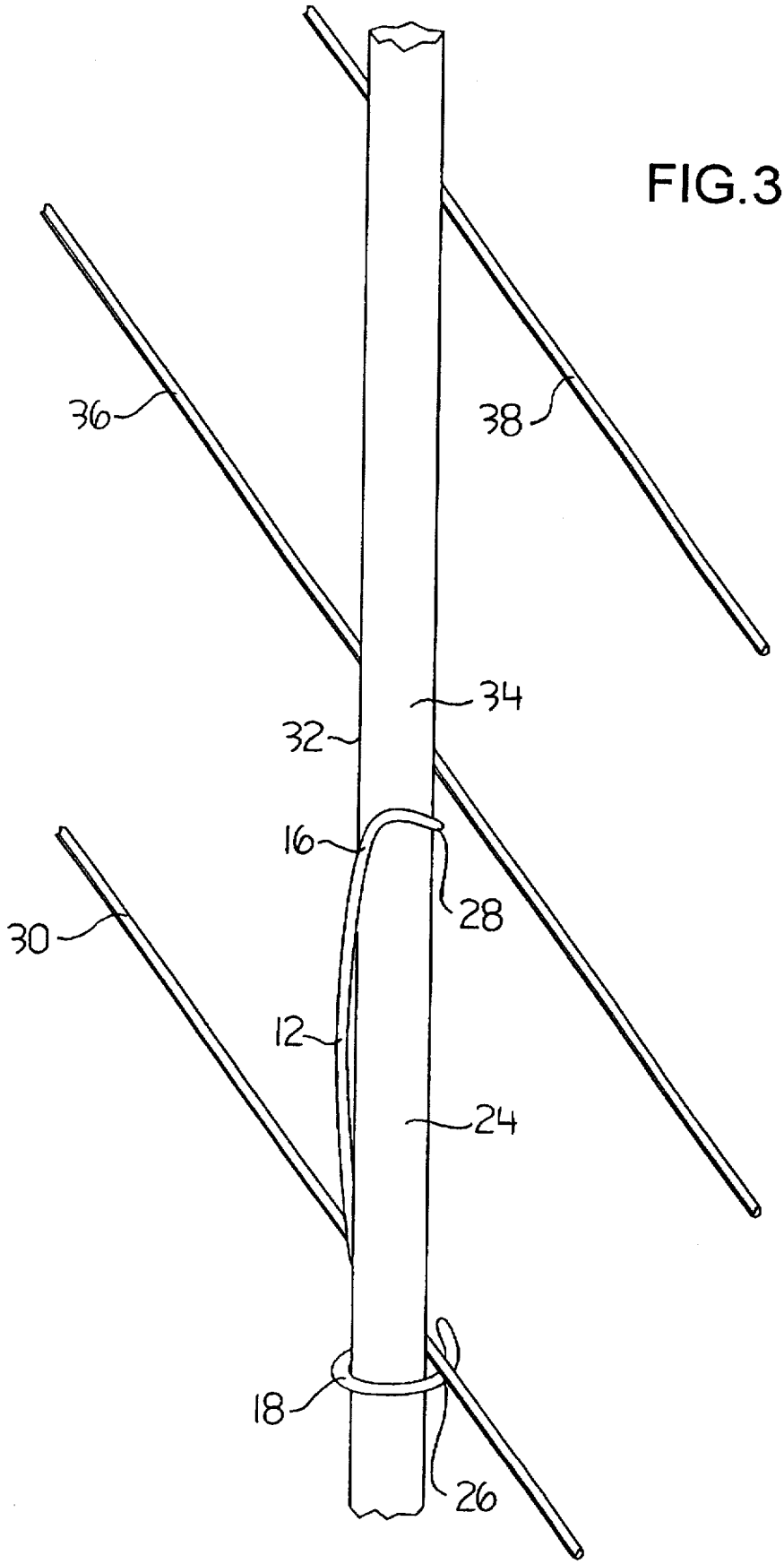
FIG. 3 is a perspective view of the fencing wire retainer illustrated in FIG. 1, illustrating a second step in constructing a three fencing wire fence.

The use of fencing wire retainer 10 in constructing wire fences will now be described with reference to FIGS. 1 through 7. Referring to FIG. 2, firstly, drive into a ground surface (not shown) a plurality of fence posts 24 in spaced apart relation. Secondly, extend a fencing wire 30 transversely between and across the plurality of fence posts 24. Thirdly, provide fencing wire retainer 10 in accordance with the teachings of the present invention. Fourthly, secure transversely extending fencing wire 30 to each of fence posts 24, in turn, by Hooking hook 18 at first end 14 of body 12 of fencing wire retainer 10 around fence post 24. Referring to FIGS. 2 and 3, position fencing wire 30 within transverse wire receiving groove 26 and pivot body 12 to a position substantially parallel to fence post 24. Secure second end 16 of body 12 to fence post 24 by positioning body 12 along one side 32 of fence post 24 and positioning arcuate finger 28 so it engages a portion on circumference 34 of fence post 24. This maintains body 12 substantially parallel to fence post 24 such that fencing wire 30 remains confined within transverse wire receiving groove 26.

Figure 4:
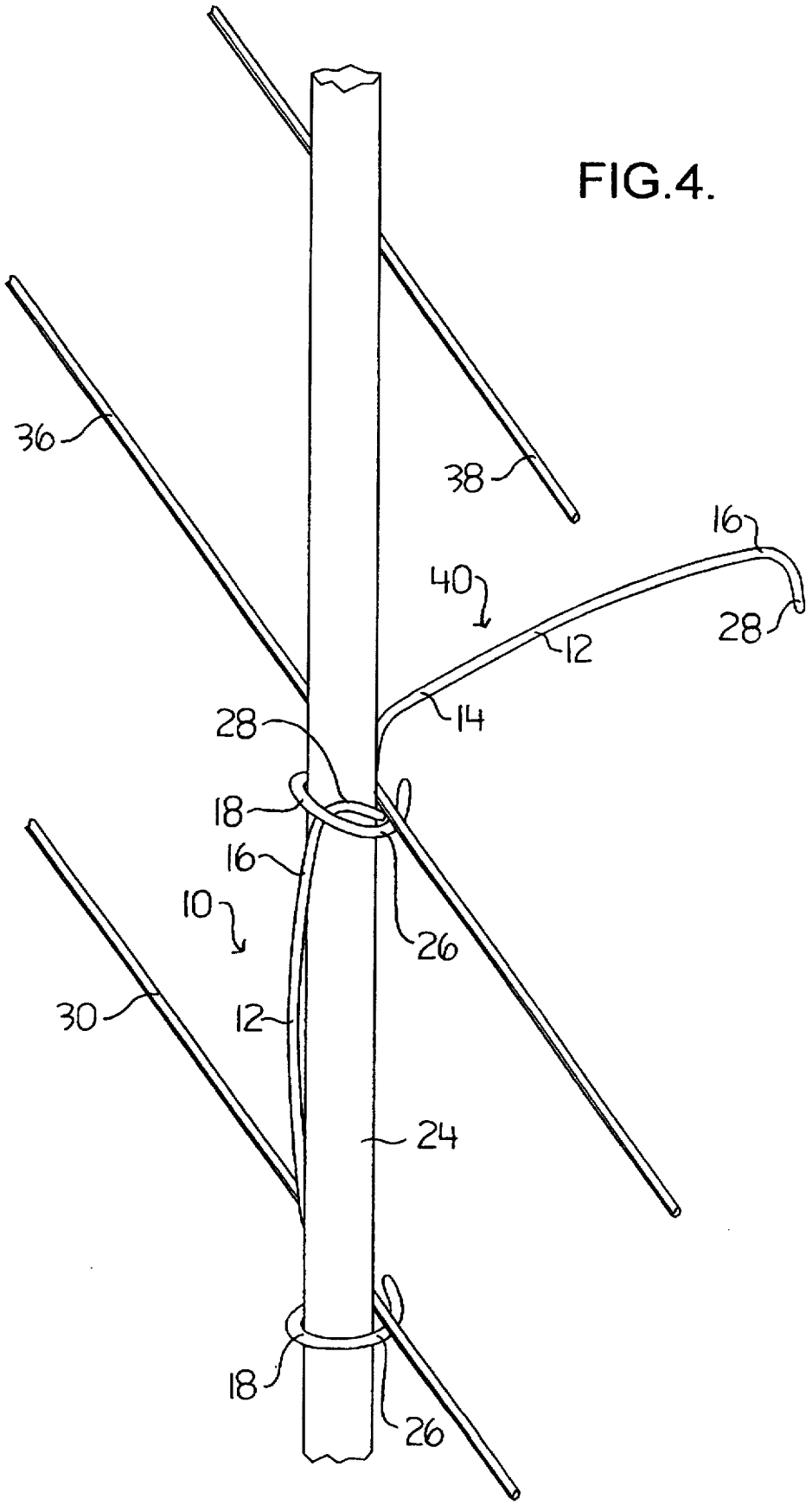
FIG. 4 is a perspective view of the fencing wire retainer illustrated in FIG. 1, illustrating a third step in constructing a three fencing wire fence.
Figure 5:
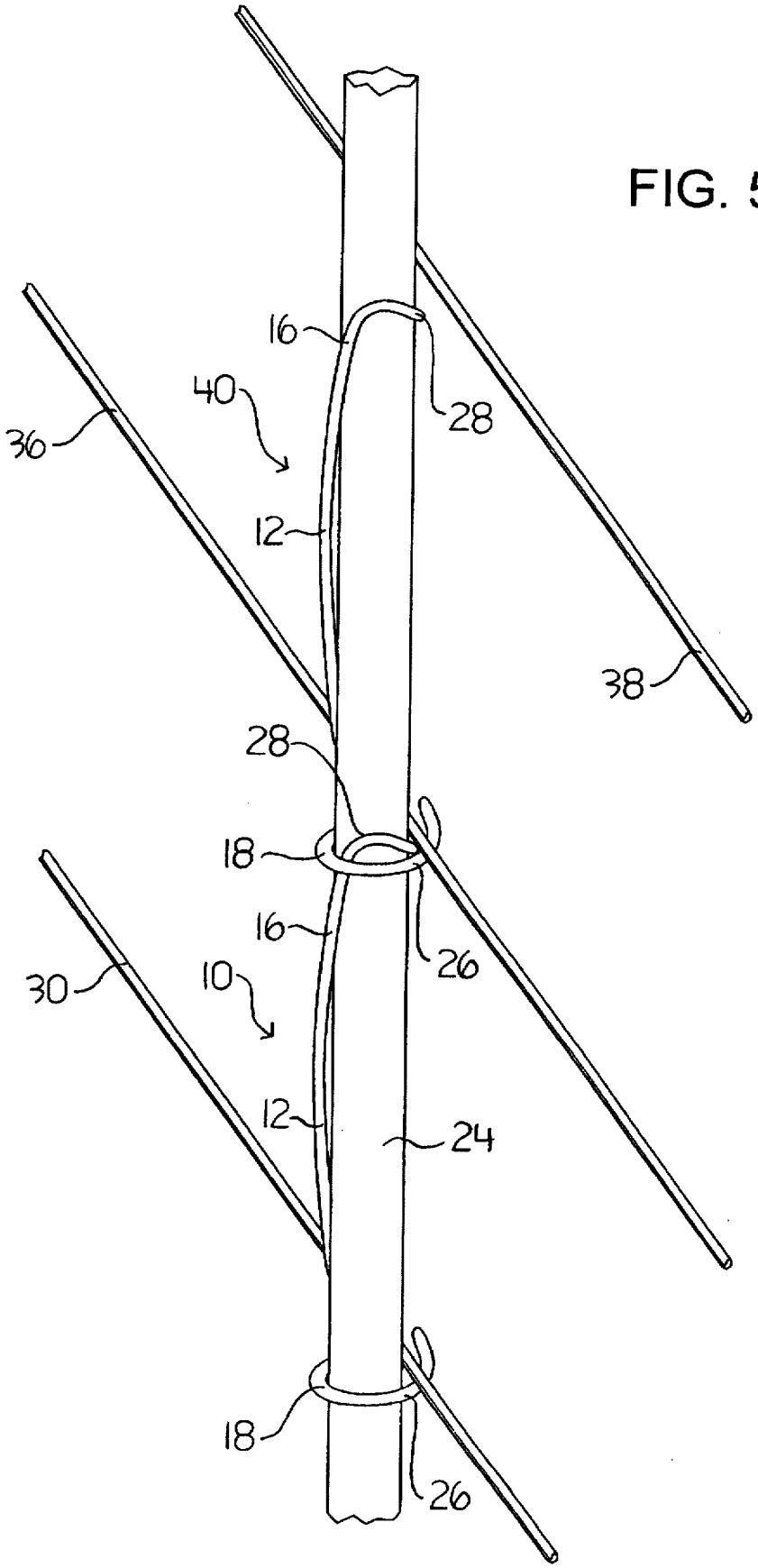
FIG. 5 is a perspective view of the fencing wire retainer illustrated in FIG. 1, illustrating a fourth step in constructing a three fencing wire fence.
Figure 6:
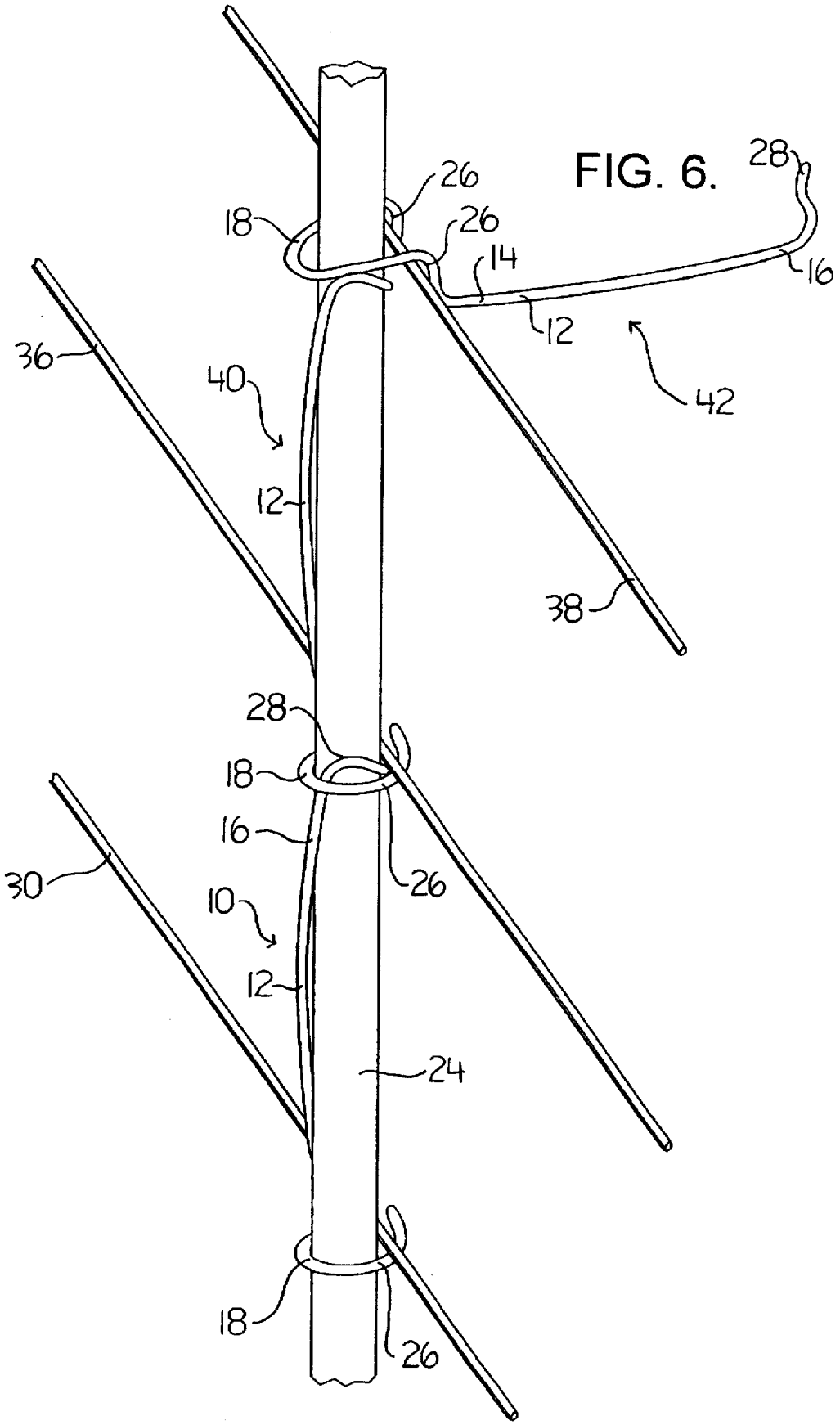
FIG. 6 is a perspective view of the fencing wire retainer illustrated in FIG. 1 illustrating a fifth step in constructing a three fencing wire fence.
Figure 7:
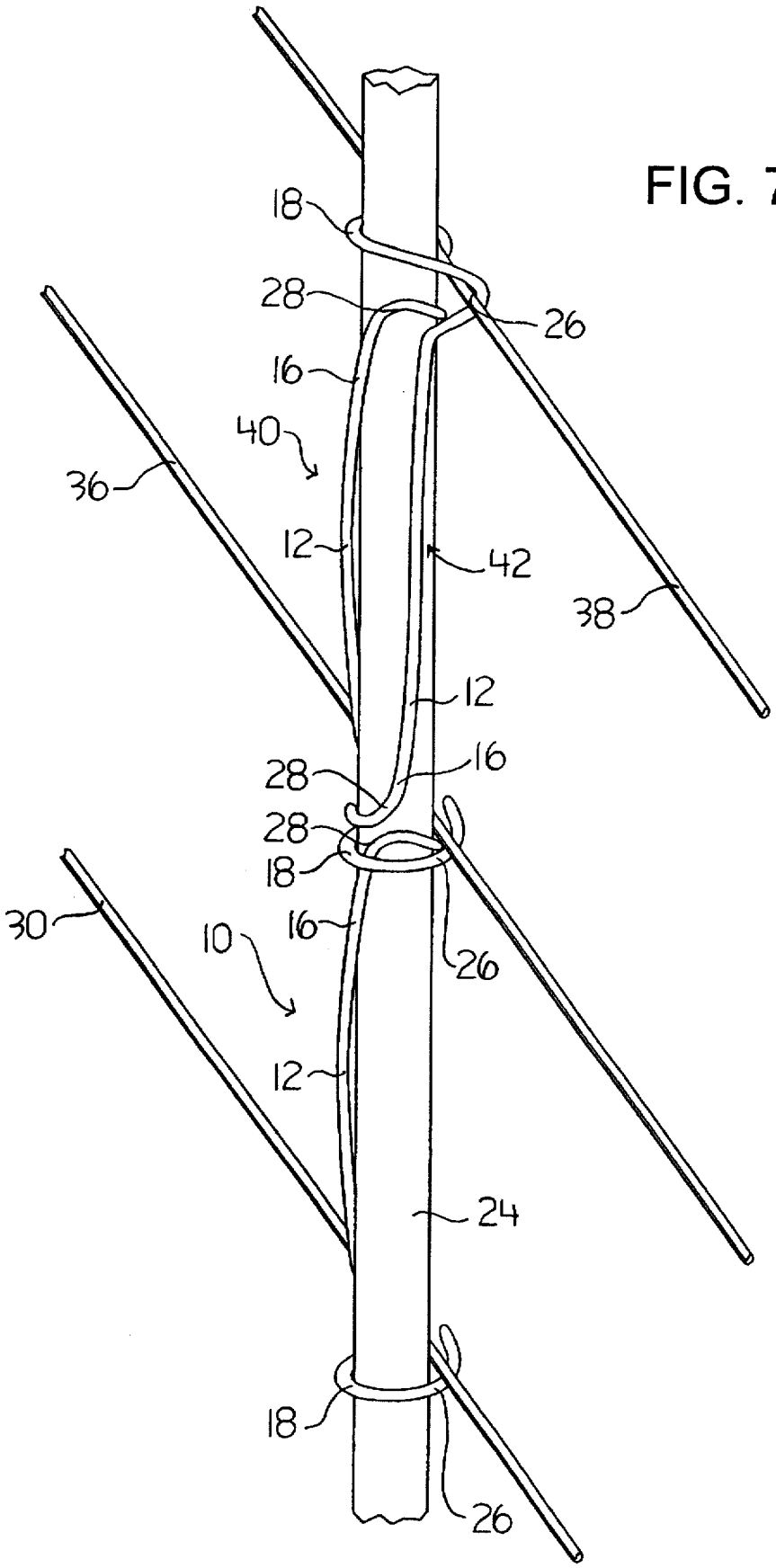
FIG. 7 is a perspective view of the fencing wire retainer illustrated in FIG. 1, illustrating a sixth step in constructing a three fencing wire fence.

Very few wire fences are constructed using just one wire. For that reason, the construction of a three wire fence will now be described. In addition to the first fencing wire 30 which has already been described, there will now be described a second fencing wire 36 and a third fencing wire 38. A second fencing wire retainer 40 is used to retain second fencing wire 36 in position. Second fencing wire retainer 40 is identical to fencing wire retainer 10 in all respects. Referring to FIGS. 4 and 5, the steps involved in installing second fencing wire retainer 40 are virtually identical to those involved in the installation of first fencing wire retainer 10, previously described. It is not essential, but it is preferred that hook 18 at first end 14 of second fencing wire retainer 40 overlap arcuate radial finger 28 at second end 16 of first fencing wire retainer 10. This serves to lock first fencing wire retainer 10 in position until second fencing wire retainer 40 is removed. A third fencing wire retainer 42 is used to retain third fencing wire 38 in position. Third fencing wire retainer 42 is identical to fencing wire retainer 10 in all respects. Referring to FIGS. 6 and 7, it will be noted that, rather than have third fencing wire retainer 42 extend past the top end of fence post 24, the installation procedure is inverted. With the exception of the inversion of third fencing wire retainer 42, the steps involved in installing third fencing wire retainer 42 are virtually identical to those involved in the installation of first fencing wire retainer 10, previously described. It will be noted, however, that arcuate radial finger 26 at second end 16 of third fencing wire retainer 42 overlays second fencing wire retainer 40. This serves to lock second fencing wire retainer 40 in position until third fencing wire retainer 42 is removed.

It will be apparent to one skilled in the art after a review of the teachings of the present invention how rapidly a wire fence can be assembled, disassembled and reassembled through the use of fencing wire retainer 10, as described. It will also be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A fencing wire retainer comprising:

a rigid wire having a substantially straight portion, a first end portion, and a second end portion;

the first end portion comprising an arcuate portion adapted for hooking around a fence post, a first groove formed between the arcuate portion and the straight portion, and a second groove formed between the arcuate portion and a free end of the first end portion, whereby the first and second grooves together form a wire receiving groove for receiving a fencing wire therein; and the second end portion comprising a finger adapted for engaging the fence post to secure the fencing wire onto the fence post and for allowing a longitudinal axis of the straight portion to be disposed substantially parallel to a longitudinal axis of the fence post.

2. A method of constructing wire fences, comprising the steps of:

firstly, driving into a ground surface a plurality of fence posts in spaced apart relation;

secondly, extending a plurality of wires transversely across the plurality of fence posts;

thirdly, providing a plurality of fencing wire retainers each of which includes:

an elongate body having a first end and a second end;

a hook at the first end of the body having an inner arcuate dimension that is greater than the outer arcuate dimension of each of the plurality of fence posts;

a wire receiving groove extending transversely across the hook; and means at the second end of the body for removably securing the body to one of the fence posts;

fourthly, securing a first of the plurality of transversely extending fencing wires to each of the plurality of fence posts in turn by hooking the first end of the body of a first of the plurality of fencing wire retainers around one of the plurality of fence posts, positioning the first fencing wire within the transverse wire receiving groove and pivoting the body to a position substantially parallel to the fence post, and securing the second end of the body to the fence post thereby maintaining the body substantially parallel to the fence post such that the first fencing wire is confined within the transverse wire receiving groove;

fifthly, securing a second of the plurality of fencing wires to each of the plurality of fence posts with a second of the plurality of fencing wire retainers, the first end of the second fencing wire retainer overlapping the second end of the first fencing wire retainer, thereby locking the first fencing wire retainer in position until the second fencing wire retainer is removed.

3. In combination:

a fence post;

a fencing wire; and a fencing wire retainer, the retainer comprising:

a rigid wire having a substantially straight portion, a first end portion, and a second end portion;

the first end portion comprising an arcuate portion for hooking around the fence post, a first groove formed between the arcuate portion and the straight portion, and a second groove formed between the arcuate portion and a free end of the first end portion, whereby the first and second grooves together form a wire receiving groove for receiving the fencing wire therein; and the second end portion comprising a finger for engaging with the fence post to secure the fencing wire onto the fence post and for allowing a longitudinal axis of the straight portion to be disposed substantially parallel to a longitudinal axis of the fence post.

* * * * *